US005823676A

United States Patent [19]

Khijniak et al.

[11] Patent Number: 5,823,676

[45] Date of Patent: Oct. 20, 1998

[54] APPARATUS AND METHOD OF GRADIENT CONVECTION VORTEX FLUID MIXING AND PUMPING

[75] Inventors: Evgueni Khijniak, Narberth, Pa.; Marvin C. Ziskin, Cherry Hill, N.J.

[73] Assignee: Technology SG, L.P., Wayne, Pa.

[21] Appl. No.: 844,721

[22] Filed: Apr. 18, 1997

[51] Int. Cl.[6] ..... B01F 5/00

[52] U.S. Cl. ..... 366/348; 366/349; 366/262; 366/144; 126/387; 219/687

[58] Field of Search ..... 366/144, 146, 366/348, 349, 273, 274; 126/373, 387, 379, 390; 165/109.1, 108, 262; 219/678, 679, 687, 690, 726, 751, 756

[56] References Cited

U.S. PATENT DOCUMENTS

| | | | |
|---|---|---|---|
| 1,598,072 | 8/1926 | Felix et al. | 126/387 |
| 2,091,013 | 8/1937 | Rawlins | 126/387 |
| 2,234,464 | 3/1941 | Caldor | 126/387 |
| 2,299,053 | 10/1942 | Ferris | 126/387 |
| 3,801,274 | 4/1974 | Gleason | 68/137 |
| 3,920,945 | 11/1975 | Smith | 219/695 |
| 3,941,118 | 3/1976 | Schutte | 126/387 |
| 4,029,927 | 6/1977 | Mcmillan | 219/710 |
| 4,152,567 | 5/1979 | Mayfield | 219/738 |
| 4,417,116 | 11/1983 | Black | 219/762 |
| 4,593,169 | 6/1986 | Thomas | 219/710 |
| 4,957,097 | 9/1990 | Chevalier et al. | 126/373 |
| 5,373,836 | 12/1994 | Mifune et al. | 126/373 |
| 5,387,780 | 2/1995 | Riley | 219/748 |
| 5,471,975 | 12/1995 | Wilke | 126/373 |
| 5,537,009 | 7/1996 | Chukanov | 315/110 |

FOREIGN PATENT DOCUMENTS

| | | | |
|---|---|---|---|
| 1065100 | 5/1954 | France | 126/387 |
| 1127498 | 12/1956 | France | 126/387 |
| 2602911 | 7/1977 | Germany | 126/387 |

*Primary Examiner*—Tony G. Soohoo
*Attorney, Agent, or Firm*—Sterne, Kessler, Goldstein & Fox P.L.L.C.

[57] ABSTRACT

A method of creating a torroidal type convection vortex in a predetermined region of a liquid to perform mixing and pumping is disclosed. This method comprises the local application of a source of energy to a predetermined region of the liquid, which absorbs the energy and produces a temperature gradient sufficient to create a stable, pulsed, or unstable torroidal type vortex in the liquid. Preferably the liquid utilized is an aqueous solution and the source of energy locally applied to the aqueous solution is millimeter wavelengths of electromagnetic radiation. By taking advantage of the creation of a torroidal type convection vortex, this method can be utilized to create a fluid mixer or a fluid pump.

23 Claims, 4 Drawing Sheets

APPARATUS AND METHOD OF GRADIENT CONVECTION VORTEX FLUID MIXING AND PUMPING

BACKGROUND OF THE INVENTION

1. Field of the Invention

The present invention relates generally to convection processes in aqueous solutions and more specifically to locally applying millimeter wavelength electromagnetic radiation (mm-waves) to an aqueous solution in order to generate a convection current flowing from the irradiated portion of the solution to the non-irradiated surface, where a convection vortex pattern is formed.

2. Related Art

Recently, interest has developed in biology-related fields studying the effects due to the application of millimeter wavelength electromagnetic radiation (mm-waves) on aqueous (water-based) solutions. One of the main mechanisms responsible for biological effects caused by mm-waves is heating due to absorption of microwave energy in water containing biological structures. Since most of the incident mm-wave energy is absorbed within the first few one-tenths of a millimeter in liquid media (Furia, L. et al., *IEEE Trans Biomed Eng BME* 33:993–999 (1986)), temperature gradients close to the irradiated surface can be high enough to produce different types of convection processes.

The physical processes describing convection are well known (Landau, L. D., & Lifshitz, E. M., *Theoretical Physics,* Vol. VI, (1986), pp. 22–24). Briefly, a free-type convection appears in a liquid when:

$$-dT/dz \geqq g\beta T/C_p, \quad (1)$$

where dT/dz is the temperature gradient, T is the temperature, $\beta=(\partial V/\partial T)_\rho/V$ is the specific temperature expression coefficient, g=acceleration due to gravity, and $C_\rho$ is the specific heat at constant pressure. Equation (1) is true for liquids that expand upon heating, i.e., $(\partial V/\partial T)_\rho>0$.

For water at 20° C., the value for the temperature gradient of Equation (1) is about 1° C. per 6.7 km (Landau, L. D., & Lifshitz, E. M., *Theoretical Physics,* Vol. VI, (1986), pp. 22–24). As a result, when physiological solutions are irradiated by 40–70 GHz mm-waves, such a temperature gradient is reached within a few seconds after the start of irradiation at an incident power density as small as $10^{-9}$ W/cm$^2$. This level of incident power density of mm-wave irradiation is usually considered to be nonthermal.

One problem that arises is specifically related to the peculiarities of convection in thin liquid layers. When a liquid layer with a constant thickness, h, is irradiated from below by mm-waves, complex convection processes (e.g., the formation of Benard-Marangoni structures) can appear. This convective phenomenon in silicon oil uniformly heated from the bottom was studied by Cerisier, P., et al., *J. Appl. Optics* 21:2153–2159 (1982), who used infrared thermography to measure the temperature differentials appearing on the surface.

Two dimensionless parameters characterize this phenomenon: the Rayleigh number ($R=\alpha g h^3\ \Delta T/v\chi$) and the Marangoni number ($M=(d\sigma/dT)\ h\Delta T/\rho v\chi$), where $\alpha$ is the linear expansion coefficient, $\rho$ is the density of the fluid, $\sigma$ is the surface tension, v is the kinematic viscosity, $\chi$ is the thermal diffusivity, and $\Delta T$ is the temperature difference between the two surfaces of the liquid.

Convection is initiated when $$R/R_{oc}+M/M_{oc}=1, \quad (2)$$

where $R_{oc}$ and $M_{oc}$ correspond, respectively, to cases where there is no surface tension gradient and where there is no gravity. The distance from the threshold is measured by $\epsilon=R/R_{oc}+M/M_{oc}-1$. The possibility of regular convective cell formation in silicon oil for values of $\epsilon$ ranging from 0.09 to 3.0 was demonstrated experimentally by using an infrared technique (Cerisier, P., et al., *J. Appl. Optics* 21:2153–2159 (1982)).

MM-waves can produce similar convection processes in aqueous solutions due to the high temperature gradients that appear close to the irradiated surface. Taking into account the fact that mm-wave antennas can produce nonuniform patterns of incident power density on an irradiated surface (Khizhnyak, E. P., & Ziskin, M. C., *IEEE Trans Biomed Eng BME* 41:865–873 (1994)), expected convection patterns will be modified by nonuniform heating patterns due to microwave absorption and that liquid streaming will be formed in the areas of hot spots. In such cases, the liquid can no longer be considered to be a homogeneous medium because of the appearance of space-organized streaming patterns.

However, the peculiarities of convection processes caused by mm-waves have not been studied in detail. Additionally, researchers in the field have not considered the possibility of temperature oscillations resulting from the interaction of continuous mm-waves with liquid media.

SUMMARY OF THE INVENTION

This invention generally relates to a method of fluid pumping and mixing. In particular, through the local application of a source of energy to a liquid that can absorb that energy, a temperature gradient is formed in the liquid that creates a torroidal type convection vortex in the liquid. This torroidal type convection vortex can be utilized as a fluid mixer, a fluid pump, or an overcritical temperature catalyzer.

According to one embodiment, the present invention is a method of creating a torroidal type convection vortex in a liquid that comprises locally applying a source of energy to the liquid, wherein the liquid absorbs the energy in a very small region which produces a temperature gradient sufficient to generate the torroidal type convection vortex. In addition, the type of vortex formed can be either a stable, pulsed, or unstable torroidal type vortex. According to a preferred embodiment, the liquid chosen is an aqueous solution and the energy locally applied to the aqueous solution is millimeter wavelengths of electromagnetic radiation (mm-waves).

In another embodiment, the present invention can be utilized as a fluid mixer by locally applying a source of energy to a predetermined region of the liquid, wherein the liquid absorbs the energy to form a temperature gradient and the torroidal type convection vortex created mixes the liquid.

According to another embodiment of the present invention, through the localized application of energy, the torroidal type convection vortex formed in the liquid facilitates the pumping of liquid from the irradiated region of the liquid to a non-irradiated region of the liquid. In accordance with the present invention, a fluid pump is disclosed that includes an energy source to be absorbed by the liquid in a localized region; a delivery means coupled to said energy source for the delivery of energy to a localized region of the liquid; and a tube, with one end located in the region of the torroidal type convection vortex, and the other end located in a predetermined region where the liquid is to be delivered. Additionally, the liquid may be held by a container transparent to the energy produced by said energy source, and a reflector surface may be placed in the liquid to provide a reverse direction flow of the liquid.

According to another embodiment of the present invention, the localized application of mm-waves is controlled to prevent the overheating of a catalyzer contained within an aqueous solution.

Further features and advantages of the present invention, as well as the structure and operation of various embodiments of the present invention, are described in detail below with reference to the accompanying drawings.

BRIEF DESCRIPTION OF THE FIGURES

The present invention will be described with reference to the accompanying figures, wherein.

In the figures, like reference numbers generally indicate identical, functionally similar, and/or structurally similar elements. The figure in which an element first appears is indicated by the leftmost digit(s) in the reference number.

DETAILED DESCRIPTION OF THE PREFERRED EMBODIMENTS

The present invention is based on the localized application of mm-waves to an aqueous solution to form a torroidal type convection vortex within the solution. Although the preferred embodiment is discussed with reference to mm-waves, the present invention has applicability to any type of energy source that produces these temperature gradients. In other words, other forms of heating that would be locally absorbed within the liquid medium could be utilized to create the torroidal type convection vortex. For example, electro-magnetic radiation from a laser source, either in the ultraviolet, visible, or infrared region of the electromagnetic spectrum, could be applied locally to the liquid to form a torroidal type convection vortex. Additionally, ultrasound waves could also be utilized in the present invention. It should also be noted that aqueous solutions are often mentioned as the specific liquid medium utilized when applying mm-waves. Other forms of liquid can also be used in this invention, depending on the type of energy source chosen.

Figure 1:
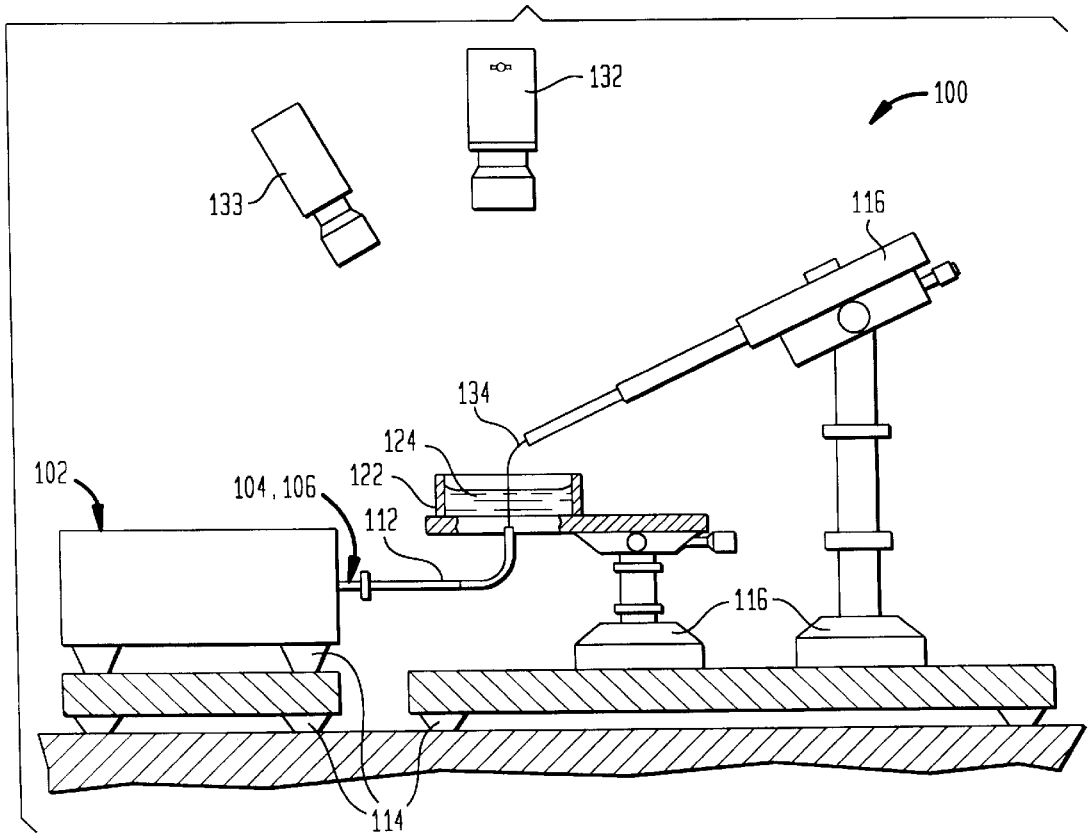
FIG. 1 is a block diagram of the convection driven mixer.
Figure 2A:
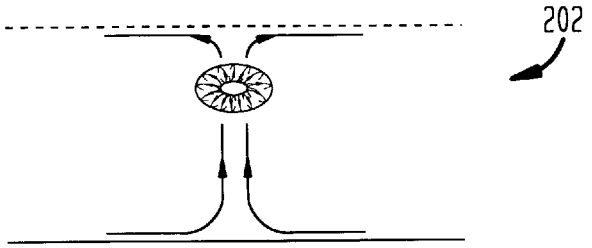
FIGS. 2*a*–2*e* describes the sequence of formation of a torroidal type convection vortex.
Figure 2B:
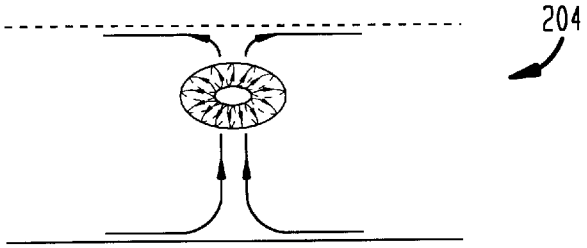
Figure 2C:
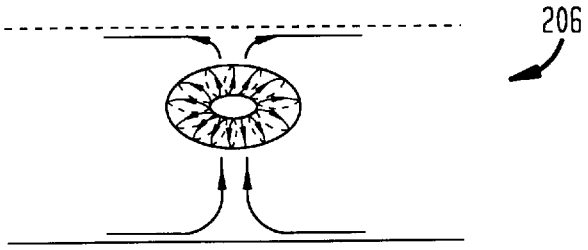
Figure 2D:
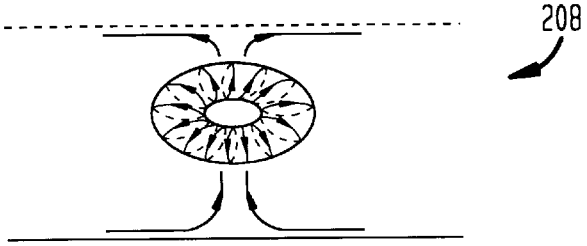
Figure 2E:
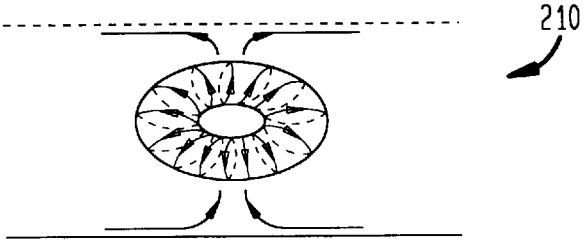

As illustrated in FIG. 1, a basic set-up utilizing the processes disclosed comprises a mm-wave generator 102, a waveguide device 112, a container 122 for holding the aqueous solution 124, wherein the convection current is generated, shock absorbers 114 for vibration sensitivity, positioning equipment 116, and solution temperature measurement equipment, comprising an infrared camera 132, a video camera 133, and a thermocouple probe 134. For example, in a typical mode of operation, the generator 102 used as the source of electromagnetic irradiation is based on a 53.57–78.33 GHz frequency range, backward-wave oscillator with an output power of up to 50 mW, ±0.05% central frequency stability, and less than 5 MHZ half-power bandwidth. The output of the generator 102 should be equipped with an isolator 104 to eliminate the influence of reflected waves on the generator's output parameters. The output power delivered to the aqueous solution 124 can be controlled by using a variable attenuator 106.

Next the mm-waves are delivered to the aqueous solution utilizing a standard waveguide device 112 well known to those skilled in the art. For example, one can use a 1.6×3.2 mm cross-sectional rectangular waveguide at a distance of 0.4–0.6 mm to deliver the mm-waves to the desired region of absorption. In a preferred embodiment, the waveguide device 112 is oriented to deliver the mm-waves to the bottom of the aqueous solution container 122.

The container 122 holding the aqueous solution 124 can be of any size and shape, with its only limitation being that it must be transparent to the mm-waves delivered to the aqueous solution 124. For example, one embodiment utilizes irradiated 0.5–3.0-mm-thick layers of liquid (100 mM NaCl solution) placed in 35- and 60-mm-diameter polystyrene Petri dishes. Using the waveguide device 112 described above, the microwave energy will be absorbed in a spot with a diameter of less than 3 mm, and the specific absorption rate (SAR) could reach 80 kW/kg in the region of the field absorption maximum.

One can optionally record the heating process of the irradiated aqueous solution using an infrared camera 132, preferably an AMBER model 4256 infrared camera (Amber Engineering, Inc., Goleta, Calif.) that has a 3–5 $\mu$m spectral window of sensitivity, 256×256 pixels per frame spatial resolution, and a 0.02° C. temperature sensitivity. Alternatively, one could also measure the temperature variations using thermocouple prove 134, preferably an MT29/3 (0.33 mm diameter, 0.025 s time constant) needle-type, copper-constantan thermocouple probe (Sensortek, Inc., Clifton, N.J.).

It is important to note that remote temperature recording using an infrared technique is a practical way to obtain correct surface-temperature dynamics data on the convection process, especially during microwave irradiation. Those skilled in the art recognize that the presence of any type of sensor in the liquid can disturb both the convection streaming pattern and the mm-wave field distribution.

In order to best utilized the present invention, the following processes must be recognized and understood. First, the desired aqueous solution is placed in a transparent container. Next, mm-waves are locally applied to a predetermined region within the container. The beam size should be about 1 cm diameter in order to ensure that the heating that occurs is in a very small localized volume. As the mm-waves are absorbed within the first few tenths of a millimeter of the aqueous solution (the solution's absorption depth region), a temperature gradient is formed. This gradient is due to the small volume of the solution rapidly heating up, thereby expanding and becoming less dense. As a result, this heated solution begins to rise, forming a column (called the convection current) that flows towards the non-irradiated surface of the solution. As the column reaches the surface, since it cannot go any higher, it begins to spread out over the surface. At this point several temperature dynamic processes can occur. For example, as the surface begins to cool, a torroidal pattern forms on the surface of the solution. As the torroidal pattern's vortex is forming, the measured temperature in the center of the torroidal pattern oscillates. This temperature oscillation ceases as the vortex becomes stabilized. Once the vortex stabilizes, the temperature at the center of the torroidal pattern begins to decrease even though heat is continually applied to the bottom of the solution.

The sequence of formation of a torroidal-type convection vortex is illustrated in FIG. 2. As the liquid begins to absorb the mm-waves that are locally applied, an unstable-type vortex 202 can begin to form near the surface of the liquid. As the mm-waves are continually applied, the vortex can continue to remain in an unstable state, as shown by stages 204, 206, and 208. However, by the end of formation 210, a stable-type vortex is achieved. Under other controllable conditions, vortex 202 could be created as an oscillatory or pulsed-type vortex. In addition, in either an unstable or pulsed mode, the vortex can consecutively follow through stages 202, 204, 206, 208. The vortex can disappear at any of these stages, or can convert into a stable form upon reaching stage 210. Typically, the time it takes a vortex to achieve a stable state depends on the irradiation level, the SAR of the liquid, and the depth of the liquid. For example, a liquid with a SAR level of 4 kW/Kg, with a liquid depth of 2.8 mm, forms a stable vortex after 30 seconds of irradiation from a 78.2 GHz mm-wave source. The reader is referred to E. P. Khizhnyak and M. C. Ziskin, "Temperature Oscillations in Liquid Media Caused by Continuous (Nonmodulated) Millimeter Wavelength Electromagnetic Irradiation," *Bioelectromagnetics* 17, 223 (Apr. 24, 1996), which is incorporated by reference in its entirety herein, for a further discussion of this and other related matters concerning the present invention.

The various types of vortices formed under irradiation are best understood in terms of the temperature dynamics they exhibit. In particular, the discoveries taught by the present invention encompass the following temperature dynamics that are observed during mm-wave irradiation: 1) an asymptotic temperature rise to a new steady-state level, depending on the specific absorption rate (SAR) in the irradiated object; 2) a temperature oscillation in liquid media with a significantly lower average temperature value; and 3) a complex biphasic temperature process in which the initial temperature rise was followed by an asymptotic temperature drop. It is necessary to note that convection processes are present in all three types of temperature dynamics.

Figure 3A:
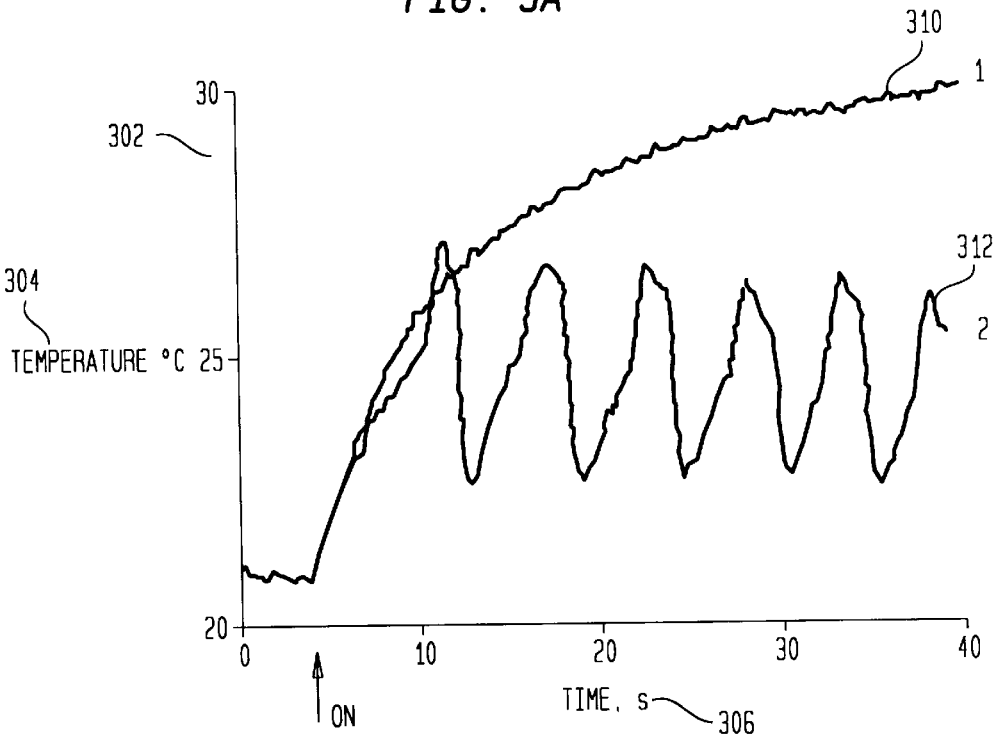
FIGS. 3A–3B describes the heating dynamics of a gel (A,B, curve 1) and a liquid (A,curve2;B,curve3) caused by 78.2 GHz mm-wave irradiation at a SAR level of 4 kW/kg.
Figure 3B:
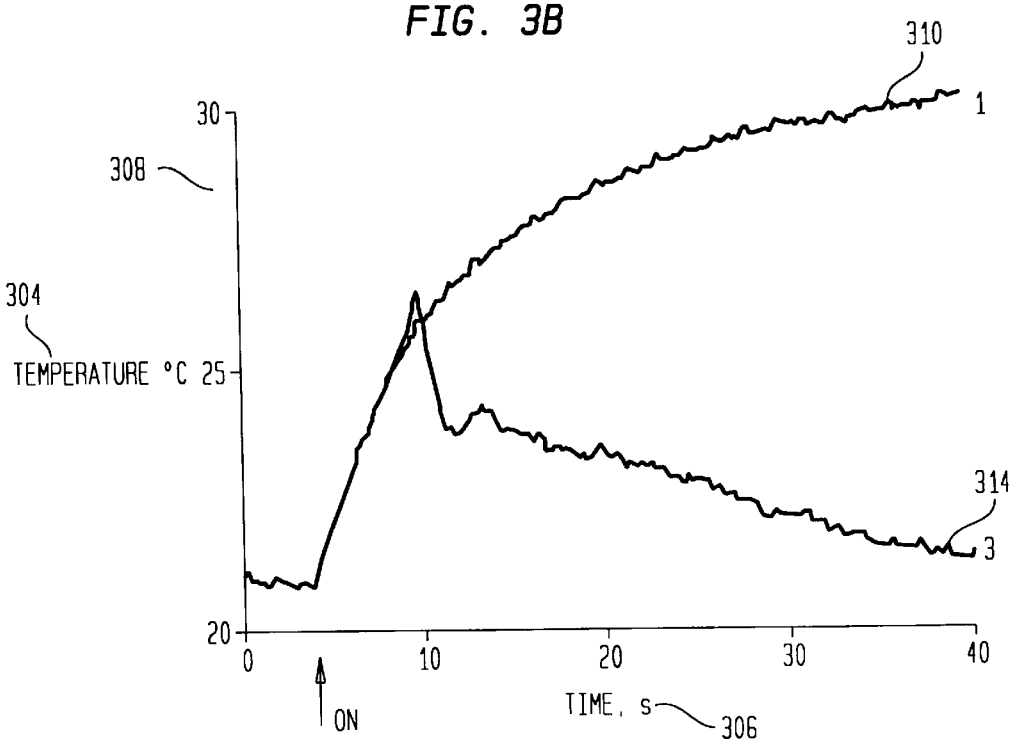

FIGS. 3A and 3B illustrate the various temperature dynamics that occur in different types of media during the local application of mm-waves. These plots 302 and 308 display the temperature 304 of the center of the vortex pattern in the irradiated media as a function of time 306. One type of temperature dynamic 310, as illustrated by curve 1 (dashed-line) in both FIGS. 3A and 3B, occurs during irradiation of all convection-disabled media (e.g., gels) at specific absorption rate (SAR) levels of up to 80 kW/kg and in liquid convection-enabled media at SAR levels less than 100 W/kg. This curve demonstrates an asymptotic rise to a new steady-state level that depends on the SAR in the irradiated media. A second type of temperature dynamic 312, shown in FIG. 3A curve 2 (solid-line), occurs during irradiation of liquid layers over 2 mm thick at SAR levels over 100 W/kg. This dynamic, referred to as an oscillatory or pulsed vortex, is characterized by a temperature oscillation in the center of the vortex, with a significantly lower average temperature value than seen in curve 1. A third type of temperature dynamic 314, displayed in FIG. 3B, curve 3 (solid-line), demonstrates a complex biphasic temperature process in which the initial temperature rise is followed by an asymptotic temperature drop. Under certain controllable irradiation conditions, it is possible to create a sequence involving all the mentioned types of temperature dynamics.

The temperature oscillations and biphasic temperature dynamics are due to a convection process that creates a torroidal type of convection vortex under mm-wave exposure. Temperature oscillations are a transient process between the initial phase of temperature rise and the secondary phase of temperature fall. Temperature oscillations present during the first 30 seconds of irradiation are the result of an unstable vortex and are related to regular sequences of the appearance and destruction of such a vortex. The spatial temperature distribution and the radius of the torroidal vortex change during irradiation, allowing the unstable vortex to change into a stable one. When the convection vortex becomes stable, temperature oscillations disappear, and the temperature at the center of the torroidal pattern at the surface of the aqueous solution begins to fall.

In another embodiment of the present invention, as illustrated in FIG. 3B, curve 3, in the case of biphasic temperature dynamics, the secondary temperature drop follows a temperature spike, which is a case of a short-lived temperature oscillatory process. The biphasic temperature process is formed when such a vortex becomes stable with the first temperature pulse.

The number of temperature pulses prior to the transition towards the secondary temperature-decreasing phase can vary from a few seconds (or even just one cycle) to 30–40 min, depending on the Rayleigh number (R) and the Marangoni number (M). An important parameter to control here is the thickness of the liquid layer h, which can increase slightly due to the swelling of the liquid layer in the region of the convection vortex. The temperature gradient formed depends both on the incident power density of mm-wave irradiation and on the frequency of irradiation, because the penetration depth of microwaves is strongly frequency-dependent within the GHz frequency range for water-containing media. Therefore, the temperature dynamics can be changed by altering the SAR or the frequency, both of which are controllable in the present invention.

In another embodiment of the invention, the amplitude of temperature oscillations slowly decreases over a sufficiently long period of time, and, after 30–40 min of irradiation, the oscillations disappear. In addition, a stable vortex may be formed directly without the temperature-oscillation phase in a liquid that has been previously irradiated by mm-waves.

As mentioned above, several relative parameters play an important role in determining the specific type of torroidal type convection vortex that will be created; the volume of the liquid, the thickness of the liquid, and the viscosity of the liquid. In addition, as the characteristics of the liquid change, one may choose to employ different energy sources, depending upon the temperature gradient desired. It is also important to note that the creation of gradient convection vortices can also be performed in larger containers holding a greater volume of liquid. For example, the present invention can be practiced in a 5' diameter container holding a very high viscosity liquid. Thus, the invention is not restricted to any specific set of parameters other than those discussed above.

The present invention also has several practical applications which are described below.

Torroidal Type Convection Vortex Fluid Mixer

By taking advantage of the creation of a torroidal type convection vortex, the present invention can be used as a fluid mixer. As mentioned above, the torroidal type convection vortex can take one of three different forms under the localized application of mm-waves: stable, pulsed, or unstable. Each of these forms represents a different embodiment of the present invention.

Figure 4:
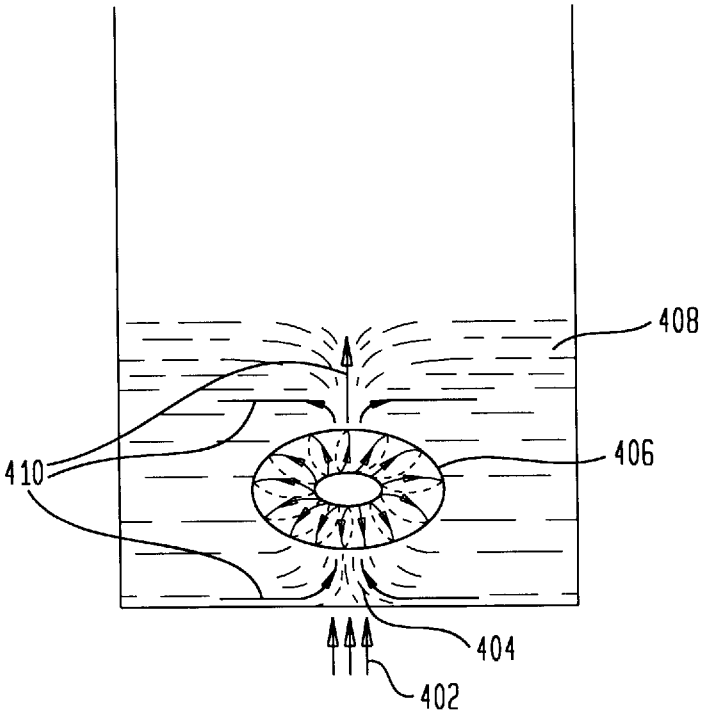
FIG. 4 illustrates the liquid flow in the region of a torroidal type convection vortex.

A stable vortex causes a temperature decrease, because both the radius of the vortex and the velocity of the liquid increase during irradiation, which increases the volume and efficiency of heat exchange. The temperature of the liquid drops in its central region as soon as a torroidal vortex is formed, because the speed of the liquid flow there can reach 1–2 cm/s, the rotation of liquid in such a torroidal vortex can reach 5–10 rps, and the radius of the torroidal vortex can reach 2 cm in a 3-mm-thick liquid layer. As an illustration, FIG. 4 graphically represents the liquid flow taking place in the presence of a stable torroidal vortex. Under mm-wave irradiation 402, a liquid 408 absorbs the mm-waves in a localized region 404, thereby forming a temperature gradient. As demonstrated above, a stable torroidal vortex 406 is formed under certain irradiation conditions, causing the liquid flow pattern shown by the arrows 410. This type of flow pattern is useful in applications requiring uniform mixing.

A situation may arise where the vortex becomes unstable. In unstable cases, the torroidal vortex is destroyed after several torroidal liquid rotations. As shown above, while the vortex exists, the temperature of the central region of the liquid decreases. However, after the destruction of the vortex, the temperature of the central region increases under continuous application of mm-waves until it reaches the point when a convection vortex reforms.

As described in the previous section, a pulsed situation may arise where the torroidal type convection vortex undergoes a series of relaxation-type temperature oscillations in the center of the vortex. This periodic temperature fluctuation provides for non-uniform mixing. In several pharmaceutical applications it is necessary to have mixers that do not use uniform mixing, but instead use a non-uniform or a pulsed-mixing regime. In the pulsed-mixing regime, the mixing process may be employed for a long term application by pulsing the mm-waves at a predetermined pulse repetition rate.

These liquid flow processes generated by the torroidal type convection vortex are useful in that they can be created even by heating a very small portion of the aqueous solution. Yet even this small irradiated region can generate enough liquid flow to create a practical and controllable fluid mixer. This mixer is an attractive device in that it contains no mechanical parts and the mixing can be directed to the localized regions exposed to the mm-waves.

Torroidal Type Convection Vortex Fluid Pump

Another utilization of the present invention is that of a fluid pump. Material located in the region of mm-wave absorption can be transported unidirectionally along the convection current to the non-irradiated surface. This fluid pumping can be achieved either under a stable, unstable or pulsed vortex regime.

Figure 5:
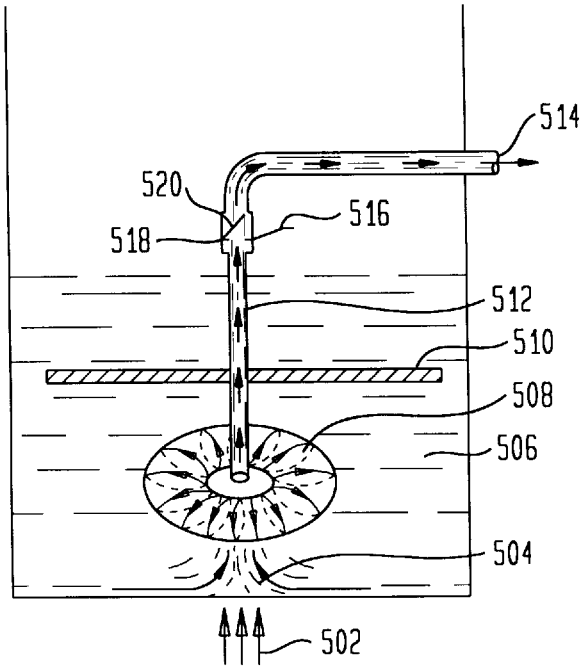
FIG. 5 is a schematic diagram of the torroidal type convection vortex fluid pump.

For example, as seen in FIG. 5, a continuous liquid flow pump can be created by locally applying mm-waves 502 to the liquid 506, wherein one small tube 512 is placed in the liquid. The mm-waves are absorbed by the liquid in a localized region 504, which corresponds to the maximum temperature gradient formed in the liquid 506. In addition, a reflector surface 510 is also placed in the liquid 506, to provide an region of reverse flow needed to optimize the torroidal vortex 508 formed. Once the vortex 508 is formed, liquid begins to flow through the tube 512 to an output port 514.

In another embodiment, a small passive-type valve 516, such as the type used in heart surgery, may be placed at a predetermined point in the small tube 516 to prevent further liquid flow when closed 518, or allow liquid flow when open 520. This valve 516 may be utilized when a pulsed vortex is created, since the liquid flow would no longer be continuous in this type of regime.

Overcritical Temperature Catalyzer

Another utilization of the present invention is a method for stabilizing a catalyzer in liquid media. Oftentimes catalyzers work at temperatures much lower than optimum with a significantly reduced efficiency. Additionally, it is very difficult to create the appropriate conditions for optimal catalyzer activity because the temperature at which the catalyzer is destroyed is frequently below that for maximal efficiency. Using data on the formation of a gradient convection torroidal vortex as a control parameter it is possible to stabilize the catalyzer (i.e. prevent it from being destroyed) at a temperature very close to the critical temperature, and in some cases at an overcritical temperature.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method of using a convection process to create a torroidal type vortex in a liquid, comprising locally applying a beam of energy to a predetermined region of the liquid, wherein the liquid absorbs said beam of energy in said predetermined region of the liquid producing a temperature gradient sufficient to create the torroidal type vortex.

2. The method of claim 1, wherein the torroidal type vortex formed by the convection process facilitates the pumping of the liquid from said predetermined region of the liquid to a non-irradiated region of the liquid.

3. The method of claim 1, wherein the liquid is an aqueous solution and said beam of energy locally applied to said predetermined region of said aqueous solution is millimeter wavelengths of electromagnetic radiation.

4. The method of claim 3, wherein said localized application of said millimeter wavelengths is controlled to prevent an overheating of a catalyzer contained within said aqueous solution.

5. The method of claim 3, wherein said beam of energy is millimeter wavelengths of a frequency from about 53 gigahertz to about 78 gigahertz.

6. The method of claim 1, wherein said beam of energy is controlled to create a stable torroidal type vortex in the liquid.

7. The method of claim 1, wherein said beam of energy is controlled to create a pulsed torroidal type vortex in the liquid.

8. The method of claim 7, wherein said beam of energy is pulsed at a predetermined pulse repetition rate.

9. The method of claim 1, wherein said beam of energy is controlled to create an unstable torroidal type vortex in the liquid.

10. A method of mixing a liquid using a convection process, comprising locally applying a beam of energy to a predetermined region of the liquid, wherein the liquid absorbs said beam of energy in said predetermined region of the liquid to form a temperature gradient in said predetermined region of the liquid sufficient to create a torroidal type vortex, wherein said torroidal type vortex mixes the liquid.

11. The method of claim 10, wherein the liquid is an aqueous solution and said beam of energy locally applied to said predetermined region of said aqueous solution is millimeter wavelengths of electromagnetic radiation.

12. The method of claim 10, wherein said beam of energy is controlled to create a stable torroidal type vortex in the liquid.

13. The method of claim 10, wherein said beam of energy is controlled to create a pulsed torroidal type vortex in the liquid.

14. The method of claim 10, therein the beam of energy is controlled to create an unstable torroidal type vortex in the liquid.

15. An apparatus for pumping a predetermined localized region of a liquid using a convection process, comprising:

an energy beam source, wherein a beam of energy supplied from said energy beam source is absorbed by the liquid in the predetermined localized region thereby forming a temperature gradient sufficient to create a torroidal type vortex;

a delivery means coupled to said energy beam source for the delivery of said beam of energy to the predetermined localized region of the liquid; and a conduit providing a flow path for the liquid, said conduit having a first end located in a region of the liquid where said torroidal type vortex is formed, and a second end located where the liquid is to be delivered.

16. The apparatus of claim 15, further comprising:

a container transparent to said beam of energy to hold the liquid; and a reflector surface placed in the liquid to provide a reverse direction flow of the liquid.

17. The apparatus of claim 16, wherein said beam of energy is incident on the predetermined localized region of the liquid for a predetermined time period sufficient to form a stable torroidal type vortex and sufficient to provide a steady flow of liquid through said conduit.

18. The apparatus of claim 16, further comprising:

a small valve mountable to said conduit, to prevent further transport of the liquid when said valve is in a closed position.

19. An apparatus for mixing a liquid using a convection process, comprising:

an energy beam source to emit a beam of energy;

a delivery means coupled to said energy beam source for delivering said beam of energy to a predetermined localized region of the liquid, wherein said beam of energy is absorbed within said predetermined localized region of the liquid thereby forming a temperature gradient sufficient to create a torroidal type vortex, where said torroidal type vortex mixes the liquid.

20. The apparatus of claim 19, wherein said beam of energy is controlled to create a stable torroidal type vortex in the liquid to perform uniform mixing.

21. The apparatus of claim 19, wherein said beam of energy is controlled to create a pulse torroidal type vortex in the liquid to perform non-uniform mixing.

22. The apparatus of claim 21, wherein said beam of energy is millimeter wavelengths of electromagnetic radiation and said energy beam source is operated at a predetermined pulse repetition rate.

23. The apparatus of claim 19, further comprising:

a container to hold the liquid to be mixed, said container being transparent to said beam of energy.

* * * * *